United States Patent [19]

Weeks

[11] Patent Number: 4,804,083

[45] Date of Patent: Feb. 14, 1989

[54] COMBINATION WATER/ICE CUBE BOTTLE

[76] Inventor: Philip A. Weeks, 84 Ellice Street, Wellington, New Zealand

[21] Appl. No.: 59,967

[22] Filed: Jun. 9, 1987

[51] Int. Cl.[4] ..... B65D 17/28; B65D 49/12

[52] U.S. Cl. ..... 206/216; 206/606; 215/1 C; 215/6; 215/32; 249/61; 249/119; 249/121; D15/90

[58] Field of Search ..... 249/52, 61, 82, 119, 249/121, 126, 127, 129, 130; 215/1 C, 6, 32; 206/253, 602, 607, 617, 216, 606; D15/90

[56] References Cited

U.S. PATENT DOCUMENTS

| | | | |
|---|---|---|---|
| 3,129,568 | 4/1964 | Knepper | 249/126 |
| 3,135,101 | 6/1964 | Nigro | 249/126 |
| 3,172,273 | 3/1965 | Knepper | 249/203 |
| 3,306,567 | 2/1967 | Frei, Sr. | 249/127 |
| 3,443,785 | 5/1969 | Ewers | 249/127 |
| 3,491,907 | 1/1970 | Eelkema | 206/617 |
| 3,684,235 | 8/1972 | Schupbach | 249/126 |
| 4,343,754 | 8/1982 | Wilde et al. | 425/809 |
| 4,432,529 | 2/1984 | McMillan | 249/126 |
| 4,453,637 | 6/1984 | Mazur | 206/617 |

FOREIGN PATENT DOCUMENTS

| | | | |
|---|---|---|---|
| 1184695 | 12/1964 | Fed. Rep. of Germany | 206/617 |
| 2500230 | 9/1975 | Fed. Rep. of Germany | 249/127 |
| 1157710 | 6/1958 | France | 249/121 |
| 191784 | 4/1981 | New Zealand . | |

*Primary Examiner*—Jay H. Woo
*Assistant Examiner*—James C. Housel
*Attorney, Agent, or Firm*—Holman & Stern

[57] ABSTRACT

A container in which fresh water can be packed and from which if desired it can be poured or if frozen from which ice cubes of any particular shape can be removed. If the container is filled with uncontaminated water, uncontaminated ice cubes can be removed therefrom.

3 Claims, 2 Drawing Sheets

COMBINATION WATER/ICE CUBE BOTTLE

Figure 1:
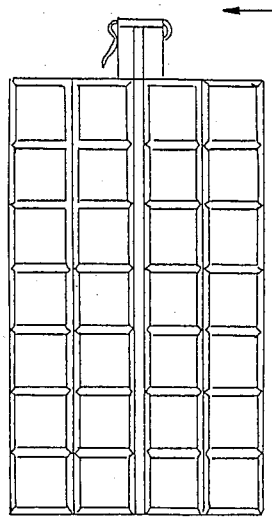

The present invention relates to improvements in and/or relating to the provisional of water or other freezable liquids and in particular, although not solely, to a combination water/ice cube bottle.

As used herein the term "ice cube" relates to any shaped solid form of water e.g. spherical, elipsoidal, rectanguloid etc.

The present invention in one aspect relates to a (preferably moulded plastics) container (preferably a bottle) for the containment of drinkable liquids. It is so designed to pour as a conventional bottle or to create, when frozen, ice cubes as hereinbefore defined capable of being extracted after breaking opening the container.

This invention is intended to solve problems that occur in countries where there is a reliance on imported bottled waters. This reliance can be due to limited natural supplies or because of the local supply being unhealthy or unpleasant to drink.

The need for large amounts of ice in such places as hotels and hospitals leads to the use of fast producing ice machines. These machines are designed to be plumbed into a mains water supply. In those countries where my invention is intended for use by consumers the piped water supplies are limited or of an unhealthy nature.

The making of ice in conventional ice trays can cause spills in the freezing area. These spills eventually result in the need to turn off a freezing area to remove the frozen spillage. In the case of large freezing rooms being used for this scale, manufactured alternative freezer space is needed for ice or other frozen produce. There is also the possibility of ice made in this way becoming contaminated or tainted by other freezing area.

The use also, of reusable ice trays demands the need for a method of cleaning trays without resorting to the limited imported water supply.

In a further aspect the present invention consists in a moulded substantially self supporting container defining a reservoir capable of moulding ice cubes (as hereinbefore defined) from liquid therein which are readily frangible from adjacent ice cubes so moulded or are substantially separate therefrom, said container having a closed opening capable of being opened to allow the pouring of a non-frozen liquid from the reservoir if unfrozen and additionally having means whereby at least the reservoir for the ice cubes can be opened to allow the extraction of individual and/or a grouping of ice cubes therefrom.

Preferably said container is of a blow moulded form.

Preferably said blow moulded form includes the provision of a tear strip to allow the opening of the reservoir.

Preferably the reservoir region of the container is defined in such a way that upon opening two substantially opposed tray like structures are defined.

Preferably a tear strip is provided which is connected to a removable seal for the pour opening of the container.

Preferably the arrangement as such is substantially as hereinafter described.

In a further aspect the present invention may broadly be said to consist in a self supporting blow or otherwise formed plastics moulded container having a reservoir defining region which can be opened by a tear strip to allow the removal of frozen individual or arrays of ice cubes therefrom, said container in addition including a sealed water pouring spout and/or opening.

Preferably the pore opening is sealed with a tamper proof sealed flap or a tamper proof screw cap.

In a further aspect the present invention may broadly be said to consist in a method for providing drinking supplies which comprises providing a container in accordance with the present invention with a liquid contained and sealed therein, the contained liquid being capable of being poured from the container when the pour opening thereof is unsealed and the liquid contents are unfrozen or of being frozen to mould ice cubes capable of being removed therefrom upon destruction of the container.

Preferably the liquid is inserted into the container via the pour opening. In other forms of the present invention however, another opening can be provided which is permanently sealed after filling.

Preferably the arrangement is such that the container is capable of standing in a stable manner with its pour opening uppermost. This facilitates the preparation of ice cubes when some of the liquid contents have been consumed.

Figure 2:
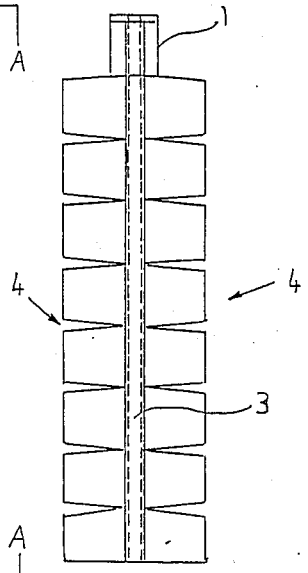
Figure 3:
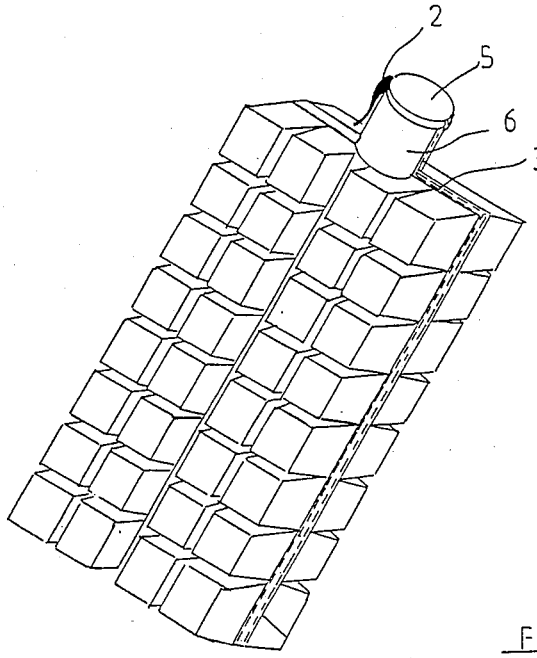
Figure 4:
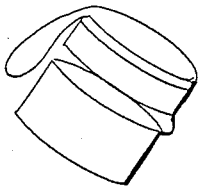
Figure 5:
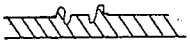
Figure 6:
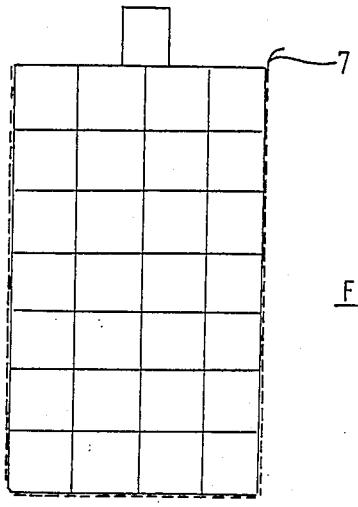
Figure 7:
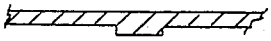
Figure 8:
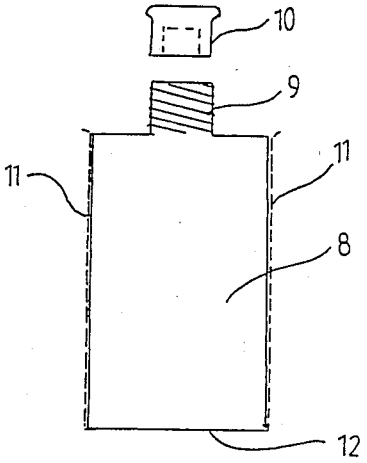
Figure 9:
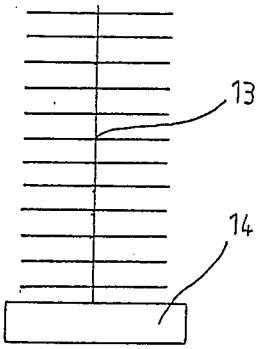

Preferred forms of the present invention will now be described with reference to the accompanying drawings in which FIG. 1 is a view from one side, FIG. 2 is a view AA with respect to FIG. 1, FIG. 3 is a perspective view of the arrangement shown in FIG. 1 and FIG. 2, FIG. 4 gives perspective detail of the preferred seal cap arrangement FIG. 5 is a cross-section of the tear strip form preferably formed by and during the blow moulding of the container, FIG. 6 is a side elevation view of another form of the present invention showing by dotted outline how a wire can, if desired, be embedded in the wall of the container, FIG. 7 shows a section of wall showing how, if desired, a tear tab of extra thickness can be formed in the wall thereof which thus provides an alternative to that previously described, FIG. 8 shows the cap and a major portion of a moulded container capable of being closed by the cap, the container not including sufficient ice cube defining means therewithin and not including a closed base and, FIG.9 shows a base forming region and ice cube defining means dependent from the base forming region capable of being inserted within the open bottomed container of FIG. 8 and being sealed, thus revealing that if necessary the filling of the container thus formed could occur other than by means of the pour opening.

A previous device for freezing water into cubes or pieces is in the form of a plastic bag. This bag is divided into pockets. When the bag is filled, sealed and frozen, individual ice pieces are formed. The bag is split open to remove the ice. Such an arrangement has been disclosed in New Zealand patent specification No. 191784.

Such bags however, are not suitable for the purpose previously stated for which the present invention is designed. For example, the shape of the bags, once filled and their unstable nature leads to the need for special spacing arrangements in freezing areas. Moreover, the filling of bags from sealed bottled water is time consuming and wasteful. Indeed there is no security against dubious piped water being used therewith. Additionally, when unfrozen the fragile nature of the bags can lead to their leaking or bursting.

In the preferred form of the present invention it is envisaged that a substantially rectanguloid bottle shape as depicted in the attached drawings would be defined, having a plurality of partitions which do not prevent the individual ice cube defining regions from being filled with water or other drinking liquids. Ideally the bottle was provided with a flat base.

Pouring spout 1 is preferably provided with a seal flap 2 capable of being pulled off as shown in FIG. 4 to pull with it the stopper and flap as shown in FIG. 4. If pulling of the flap is continued the tear strip region 3 would be pulled and the parts 4 of the reservoir area can be parted to release the contents. This of course, would only occur in the situation where the contents are frozen. It is envisaged that the flap portion 5 would be upstanding from the annular cross-sectioned portion 6 after the moulding stage. It would be sealed into position together with its flap 2 after filling with the liquid.

Ideally the tear strip 3 or other frangible portion encircled substantially all of the bottle although it need not do so completely.

Many manufacturing techniques can be used for making the container. Several alternatives exist for the provision of the frangible portion. FIG. 6 shows a container having a wire embedded in the wall thereof, the general extent of the wire being shown by the dotted outline. The wire would be provided with a tab, for example at 7, which can be pulled to allow the opening of the reservoir for the removal of ice cubes therefrom. FIG. 7 shows an alternative to the embedded wire, namely the provision of a tear strip of larger section than that of the surrounding wall, thus meaning that the tear strip will tear on one or both of its sides from the walls.

The manufacture of a container can be made by providing a container body 8 with a pour opening or spout 9 to which a cap 10 is engageable, preferably in a tamper proof manner. The reservoir body can include frangible means 9 shown by dotted outlines, as can if wished, the top of the portion 8 or a portion about the bottom thereof (not shown). Engageable within the open bottomed portion 8 via the bottom 12 thereof is an ice cube defining structure 13 dependent from a base defining portion 14 capable of being welded to seal the bottom of the container body portion 8, thus it is possible to fill the structure via the opening 12 and to seal the same is that is deemed appropriate although most conveniently it is likely that the pour opening 9 will be utilised.

In other forms of the present invention it should be realized that ice cubes could perhaps be eased out of any pour opening without the necessary destruction of the container and such alternative forms of the present invention fall within the scope of the present invention. It should also be appreciated that the container can be formed in such a way that at least some of any ice cubes formed therein can carry some logo or mark, for example to distinguish the water as being from New Zealand.

A person skilled in the art will appreciate the many different tamper proof and container forming technologies available.

It is envisaged in use that where the contents are frozen and ice cubes are to be obtained therefrom the frozen container could be hammered or dropped to separate individual ice cubes from each other prior to opening. Alternatively, they can be pulled out when in arrays.

It is believed that a self-supporting plastics container in accordance with the present invention should find widespread acceptance. It will, for example, allow quantities of New Zealand water to be exported in a tamper proof manner for use in much of the Middle East or other areas of the world where top quality table waters and ice made from such waters in an uncontaminated manner are desired.

What is claimed is:

1. A package comprising a container having a body of self-supporting plastic material defining an internal reservoir, means in the reservoir for molding water into a plurality of separable ice chunks, water in a liquid or solid state at least partially filling the reservoir, means on the body for destructively opening the reservoir to allow extraction of ice chunks therefrom, means providing a resealable tamper proof closure for the reservoir, and the body having a base means for stably supporting the container with the opening located above the reservoir wherein the means providing the opening includes a sealed closure with a tear strip for irreversibly releasing the closure and wherein the tear strip extends at least partially around the body of the container to form said means for destructively opening the reservoir.

2. A package as defined in claim 1 wherein the tear strip is adapted for separating the body into two substantially tray-like parts, with said means for molding being included in each of said parts.

3. A container for water in a liquid or solid state comprising a container body of self-supporting plastic material defining an internal reservoir, means within the reservoir for molding water contained therein into a plurality of ice chunks, means on the body for destructively opening the reservoir to allow extraction of ice chunks, means defining an opening into the reservoir at one end of the body, means for providing tamper proof closure of said opening, and means at the other end of the body defining a base for stably supporting the container thereon wherein the means for destructively opening the container comprises a tear strip extending at least partially around the body for separating the body into two parts, and wherein the means providing tamper proof closure of said opening includes a closure which is sealed by said tear strip.

* * * * *